US008245661B2

(12) United States Patent
Hailey et al.

(10) Patent No.: US 8,245,661 B2
(45) Date of Patent: Aug. 21, 2012

(54) MAGNETIC SEPARATION OF DEVITRIFIED PARTICLES FROM CORROSION-RESISTANT IRON-BASED AMORPHOUS METAL POWDERS

(75) Inventors: Phillip D. Hailey, Livermore, CA (US); Sumner D. Day, Danville, CA (US); Joseph C. Farmer, Tracy, CA (US); Nancy Yang, Lafayette, CA (US); Thomas M. Devine, Jr., Moraga, CA (US); Larry Kaufman, Brookline, MA (US)

(73) Assignees: Lawrence Livermore National Security, LLC, Livermore, CA (US); Sandia National Laboratories, Livermore, CA (US)

( * ) Notice: Subject to any disclaimer, the term of this patent is extended or adjusted under 35 U.S.C. 154(b) by 1048 days.

(21) Appl. No.: 11/595,056

(22) Filed: Nov. 9, 2006

(65) Prior Publication Data

US 2007/0281102 A1 Dec. 6, 2007

Related U.S. Application Data

(60) Provisional application No. 60/811,368, filed on Jun. 5, 2006.

(51) Int. Cl.
*B05C 19/00* (2006.01)
*B05B 15/02* (2006.01)
*B05B 5/025* (2006.01)

(52) U.S. Cl. ..... 118/629; 118/621; 118/627; 118/639; 118/308; 118/302

(58) Field of Classification Search ..... 118/302, 118/308, 309, 620–640; 427/372.2, 180, 427/446, 569; 164/19, 498; 239/79, 602; 209/562, 212, 213
See application file for complete search history.

(56) References Cited

U.S. PATENT DOCUMENTS 3,670,400 A * 6/1972 Singer ..... 29/527.5
4,880,482 A 11/1989 Hashimoto et al.
4,925,103 A * 5/1990 Muench et al. ..... 239/79

(Continued)

FOREIGN PATENT DOCUMENTS

WO WO 2005/024075 A2 3/2005

OTHER PUBLICATIONS

Patil, U., et al, "An unusual phase tranformation during mechanical alloying of an Fe-bsed bulk metallic glass composition," Journal of Alloys and Compounds 389 (2005) 121-126.

(Continued)

*Primary Examiner* — Yewebdar Tadesse
(74) *Attorney, Agent, or Firm* — Eddie E. Scott

(57) ABSTRACT

A system for coating a surface comprising providing a source of iron-based amorphous metal, the iron-based amorphous metal including devitrified ferrite; directing the iron-based amorphous metal toward the surface by a spray for coating the surface; and separating at least a portion of the devitrified ferrite from the spray before the spray reaches the surface. Also an apparatus for coating a surface comprising a source of iron-based amorphous metal, the iron-based amorphous metal including devitrified ferrite; an application system for directing the iron-based amorphous metal toward the surface by a spray for coating the surface, and a system for separating at least a portion of the devitrified ferrite from the spray before the spray reaches the surface.

20 Claims, 4 Drawing Sheets

U.S. PATENT DOCUMENTS

| | | | | |
|---|---|---|---|---|
| 5,261,611 | A * | 11/1993 | Huxford | 239/690 |
| 5,486,240 | A | 1/1996 | McCallum et al. | |
| 5,626,691 | A | 5/1997 | Li et al. | |
| 5,690,889 | A | 11/1997 | McCallum et al. | |
| 5,743,961 | A * | 4/1998 | Wright et al. | 118/620 |
| 5,803,992 | A | 9/1998 | McCallum et al. | |
| 6,125,912 | A | 10/2000 | Branagan et al. | |
| 6,258,185 | B1 | 7/2001 | Branagan et al. | |
| 6,261,386 | B1 | 7/2001 | Perepezko et al. | |
| 6,358,319 | B1 * | 3/2002 | Huykman et al. | 118/308 |
| 6,562,156 | B2 | 5/2003 | Liu | |
| 6,767,419 | B1 | 7/2004 | Branagan | |
| 2003/0051781 | A1 | 3/2003 | Branagan | |
| 2003/0164209 | A1 | 9/2003 | Poon et al. | |
| 2004/0140017 | A1 | 7/2004 | Branagan | |
| 2004/0140021 | A1 | 7/2004 | Branagan | |
| 2004/0250926 | A1 | 12/2004 | Branagan | |
| 2004/0250929 | A1 | 12/2004 | Branagan | |
| 2004/0253381 | A1 | 12/2004 | Branagan | |
| 2005/0013723 | A1 | 1/2005 | Branagan | |
| 2005/0084421 | A1 | 4/2005 | Unger et al. | |
| 2005/0129581 | A1 | 6/2005 | McBride et al. | |
| 2005/0252773 | A1 | 11/2005 | McBride et al. | |

OTHER PUBLICATIONS

Wang, W.H., et al., "Enhancement of the soft magnetic properties of FeCoZrMoWB bulk metallic glass by microalloying," J. Phys.: Conden. Matter 16 (2004) 3719-3723.

Shen, J., et al, "Exceptionally high glass-forming ability of an FeCoCrMoCBY alloy," Applied Physics Letters 86, (2005) 151907-1-3.

Chen, Q.J., et al., "Glass-Forming Ability of an Iron-Based Alloy Enhanced by Co Addition and Evaluated by a New Criterion," Chin. Phys.Lett., vol. 22, No. 7 (2005) 1736-1738.

Lin, C.Y., et al., "Soft magnetic ternary iron-boron-based bulk metallic glasses," Applied Physics Letters 86, (2005), 162501-1-3.

Hu, Y., et al., "Synthesis of Fe-based bulk metallic glasses with low purity materials by multi-metalloids addition," Materials Letters 57, (2003), 2698-2701.

* cited by examiner

MAGNETIC SEPARATION OF DEVITRIFIED PARTICLES FROM CORROSION-RESISTANT IRON-BASED AMORPHOUS METAL POWDERS

CROSS-REFERENCE TO RELATED APPLICATIONS

This application claims the benefit of U.S. Provisional Patent Application No. 60/811,368 filed Jun. 5, 2006 and titled "Magnetic Separation of Devitrified Particles from Corrosion-Resistant Iron-Based Amorphous Metal Powders." U.S. Provisional Patent Application No. 60/811,368 filed Jun. 5, 2006 and titled "Magnetic Separation of Devitrified Particles from Corrosion-Resistant Iron-Based Amorphous Metal Powders" is incorporated herein by this reference.

The United States Government has rights in this invention pursuant to Contract No. W-7405-ENG-48 between the United States Department of Energy and the University of California for the operation of Lawrence Livermore National Laboratory.

BACKGROUND

1. Field of Endeavor

The present invention relates to amorphous metal powders and more particularly to magnetic separation of devitrified particles from corrosion-resistant iron-based amorphous metal powders.

2. State of Technology

U.S. Pat. No. 4,880,482 issued Nov. 14, 1989 to Koji Hashimoto et al for highly corrosion-resistant amorphous alloy provides the following state of technology information, "It is generally known that a conventionally processed alloy has a crystalline structure in the solid state. However, an alloy having a specific composition becomes amorphous by prevention of the formation of long-range order structure during solidification through, for example, rapid solidification from the liquid state, sputter deposition or plating under the specific conditions; or by destruction of the long-range order structure of the solid alloy through ion implantation which is also effective for supersaturation with elements necessary for the formation of the amorphous structure."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a system for coating a surface. The system comprises providing a source of iron-based amorphous metal, the iron-based amorphous metal including devitrified ferrite; directing the iron-based amorphous metal toward the surface by a spray for coating the surface; and separating at least a portion of the devitrified ferrite from the spray before the spray reaches the surface. In one embodiment the separating at least a portion of the devitrified ferrite from the spray before the spray reaches the surface comprises magnetically separating at least a portion of the devitrified ferrite from the spray before the spray reaches the surface. In another embodiment the separating at least a portion of the devitrified ferrite from the spray before the spray reaches the surface comprises magnetically separating at least a portion of the devitrified ferrite from the spray before the spray reaches the surface using a natural magnet. In yet another embodiment the separating at least a portion of the devitrified ferrite from the spray before the spray reaches the surface comprises magnetically separating at least a portion of the devitrified ferrite from the spray before the spray reaches the surface using an electromagnet.

The present invention also provides an apparatus for coating a surface comprising a source of iron-based amorphous metal, the iron-based amorphous metal including devitrified ferrite; an application system for directing the iron-based amorphous metal toward the surface by a spray for coating the surface, and a system for separating at least a portion of the devitrified ferrite from the spray before the spray reaches the surface. In one embodiment the system for separating at least a portion of the devitrified ferrite from the spray before the spray reaches the surface comprises a magnet system for separating at least a portion of the devitrified ferrite from the spray before the spray reaches the surface. In another embodiment the system for separating at least a portion of the devitrified ferrite from the spray before the spray reaches the surface comprises at least one bar magnet in a rotating drum for magnetically separating at least a portion of the devitrified ferrite from the spray before the spray reaches the surface.

The present invention has use for containers for shipment, storage and disposal of spent nuclear fuel; pressurized water reactors; boiling water reactors; Gen IV reactors with liquid metal (PbBi) coolant; metal-ceramic armor; projectiles; gun barrels, tank loader trays, rail guns, non-magnetic hulls, hatches, seals, propellers, rudders, and planes, ships and submarines; oil and water drilling equipment; earth moving equipment; tunnel-boring machinery; pump impellers and shafts, and other equipment.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1:
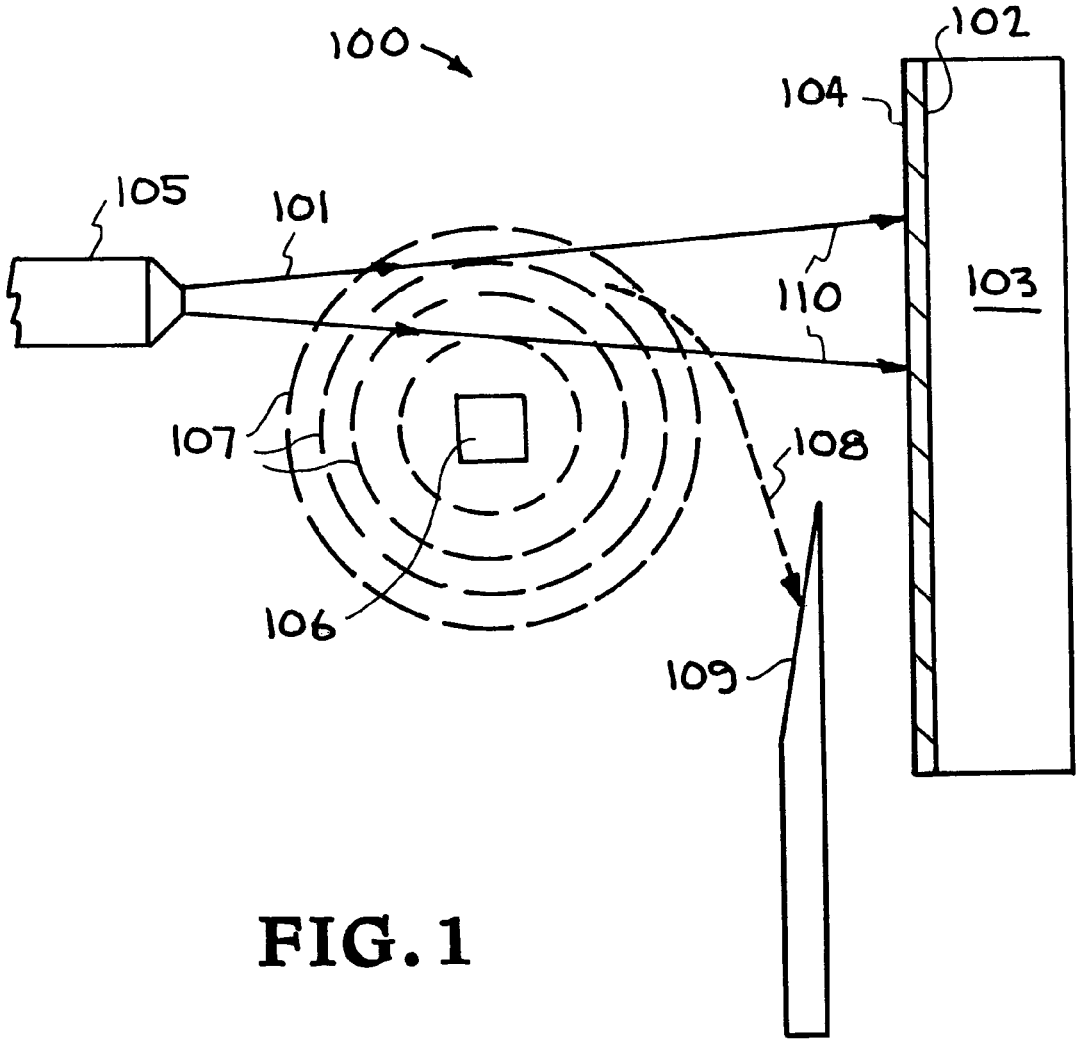
FIG. 1 illustrates one embodiment of a system incorporating the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Referring now to FIG. 1, one embodiment of a system incorporating the present invention is illustrated. This embodiment is designated generally by the reference numeral 100. In the system 100, amorphous metal 101 is applied to a surface 102 of a structure 103 to form a coating 104. A spray system 105 is used to the produce the amorphous metal spray 101 and form the coating 104. The spray system 105 is illustrated directing the amorphous metal spray 101 onto the surface 102 of the structure 103. Different spray devices and processing systems can be used as the spray system 105.

Undesirable Ferrite

In various embodiments, Applicants' iron-based amorphous metal 101 contains chromium, molybdenum and tungsten for enhanced corrosion resistance, boron for glass formability, and yttrium to inhibit the growth of crystalline phases, thereby lowering the critical cooling rate of the material. Unfortunately, if these materials are improperly processed, the powders used to produce the coatings can undergo devitrification, which results in the formation of precipitated crystalline phases of both Cr2B and bcc ferrite. Frequently, these crystalline phases form in particles of relatively large diameter, since it is impossible to maintain the heat transfer conditions above the critical cooling rate across the entire particle diameter. In the case of Applicants' SAM2X5 formulation in particular, particles above 53 microns are crystalline, with the undesirable ferrite phase present. Particles below this critical size are usually amorphous, with relatively little ferrite, provided that the gas atomization is conducted properly. Otherwise, the entire range of particle sized may contain particles with bcc ferrite.

The presence of bcc ferrite has been correlated with poor corrosion performance, and should not be used to produce coatings. The system 100 renders problematic SAM2X5 powders, and related formulations, useful for the production of corrosion-resistant thermal spray coatings by using magnetic field to separate at least a portion of the ferrite-containing particles from those which do not contain ferrite, and are therefore more corrosion resistant.

Removable of Undesirable Ferrite

Referring again to FIG. 1, the amorphous metal spray 101 contains undesirable ferrite. The system 100 removes this undesirable ferrite from the amorphous metal spray 101. A magnet 106 produces a magnetic field 107 that intersects the amorphous metal spray 101. The undesirable devitrified ferrite is diverted out of the amorphous metal spray 101 by the magnetic field 107. This diverted portion is shown as diverted spray portion 108 and is further illustrated by a dotted line arrow. The diverted spray portion 108 is diverted from the amorphous metal spray 101 into a collector 109. The remaining portion 110 of the spray 101 is directed onto the surface 102 of the structure 103 to form the coating 104.

Figure 2:
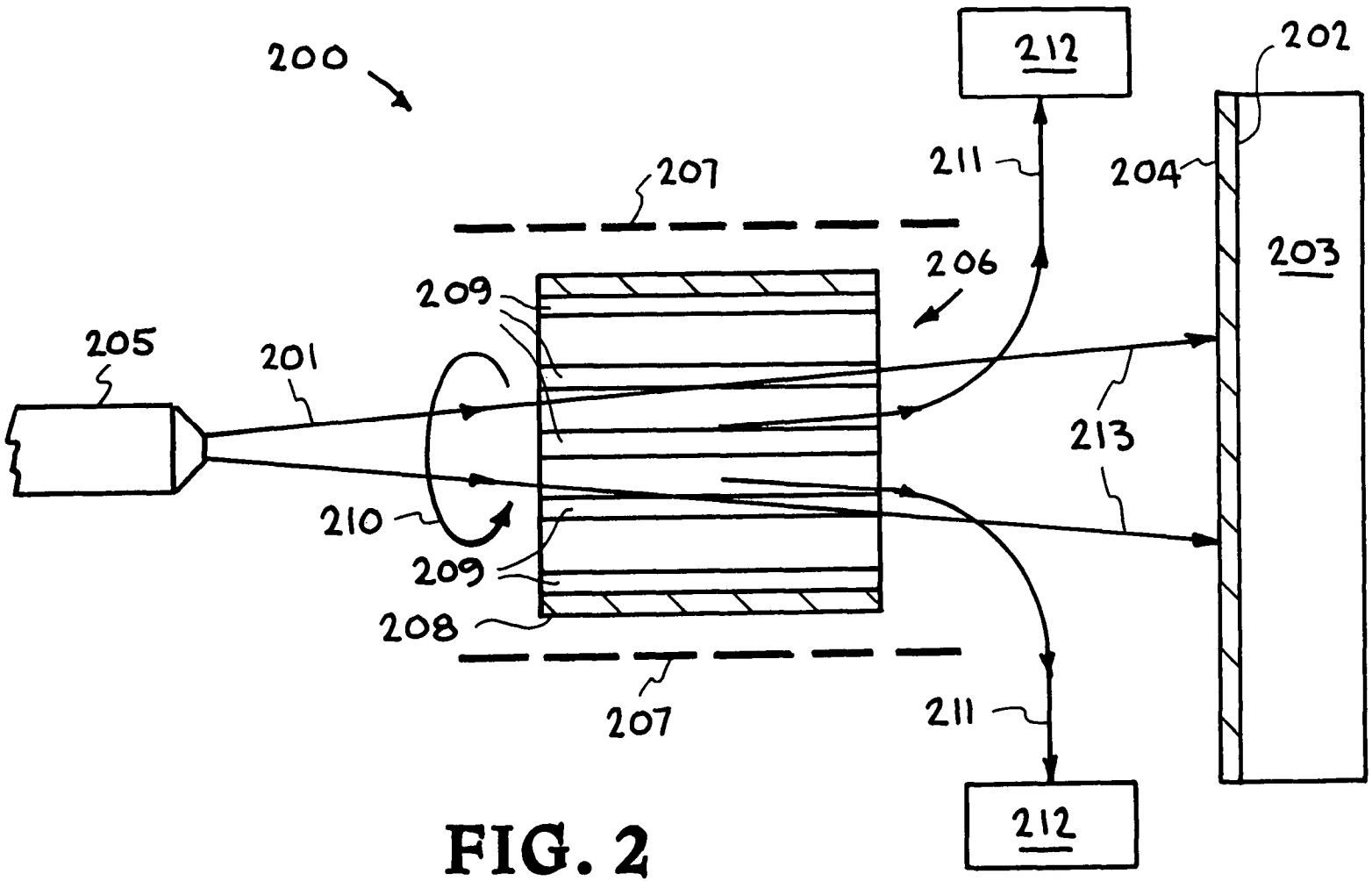
FIG. 2 illustrates another embodiment of a system incorporating the present invention.

Referring to FIG. 2, another embodiment of a system incorporating the present invention is illustrated. This embodiment is designated generally by the reference numeral 200. In the system 200, amorphous metal 201 is applied to a surface 202 of a structure 203 to form a coating 204. A spray system 205 is used to produce the amorphous metal spray 201 and form the coating 204. The spray system 205 is illustrated directing the amorphous metal spray 201 onto the surface 202 of the structure 203. Different spray devices and processing systems can be used as the spray system 205.

The amorphous metal spray 201 contains undesirable ferrite. The system 200 removes this undesirable devitrified ferrite from the amorphous metal spray 201. A magnet system 206 produces a magnetic field 207 that intersects the amorphous metal spray 201. The undesirable devitrified ferrite is diverted out of the amorphous metal spray 201 by the magnetic field 207.

The magnet system 206 utilizes a rotating drum 208 with a multiplicity of magnetic bars 209 to produce the magnetic field 207. The rotation of the drum 208 is illustrated by the arrow 210. The undesirable devitrified ferrite is diverted out of the amorphous metal spray 201 by the rotating magnetic field 207. The diverted portion is shown as diverted spray portion 211 and is further illustrated by the arrows. The diverted spray portion 211 is diverted from the amorphous metal spray 201 into a collector 212. The remaining portion 213 of the spray 201 is directed onto the surface 202 of the structure 203 to form the coating 204.

Referring again to FIGS. 1 and 2, the systems 100 and 200 will be described in greater detail. High-performance iron-based amorphous metal formulation coatings 103 and 204 are applied by the spray systems 104 and 205. Various high-performance iron-based amorphous metal formulations have been developed by Applicants that produce the coatings 103 and 204. The High-performance iron-based amorphous metal formulations that produce the coatings 103 and 204 provide corrosion resistance approaching that of Ni-based Alloy C-22. Alloy C-22 is a nickel, chromium, molybdenum alloy that know in the prior art and is commercially available. Applicants' high-performance iron-based amorphous metal formulations are rendered as the protective coatings 103 and 204 by first producing gas-atomized powders, and then thermally spraying those powders onto the respective surfaces 101 and 202 to be coated using the spray processing systems 104 and 205. The preferred thermal spay systems 104 and 205 that has produced the best results thus far for Applicants is a high-velocity oxy-fuel (HVOF) process.

In the systems 100 and 200 the undesirable devitrified ferrite is diverted out of the amorphous metal spray 101 and 201 by the magnetic fields 107 and 207. The diverted portions 108 and 211 are diverted from the amorphous metal sprays 101 and 201 into collectors 109 and 212. The remaining portions 110 and 213 of the sprays 101 and 201 are directed onto the surfaces 102 and 202 of the structures 103 and 203 to form the coatings 104 and 204.

The magnetic separation can be performed at various positions in the atomization and thermal spray processes. For example, the magnetic field can be applied in the vicinity of the gas atomization nozzle, after collection of the atomized powder, during the pneumatic conveyance of the powder to the thermal spray torch, in the torch assembly, or downstream of the thermal spray torch, prior to particle impingement of the particles on the surface being coated. In the case of separating ferrite-containing particles from an inventory of powder, several options exist. One consists of using large Teflon-coated magnetic stir bars in a rotating drum to getter ferromagnetic particles. Another involves the use of parallel troughs, with a strong magnetic field to preferentially divert flowing powder into one of the two parallel troughs (similar to classic Franz separator). Ferrite-containing powder entrained in a carrier gas can also be diverted into a collection volume through the application of a magnetic field. Other embodiments use other devitrified ferrite separation systems. For example other embodiments use (1) magnetic-field assisted cyclonic separation; (2) magnetic-field assisted centrifugation; (3) magnetic-field assisted sieving and filtration; and (4) magnetic-field assisted settling separation.

In most cases, perhaps with the exception of the magnetic stir bars, the magnetic fields can be produced by natural magnets, or produced by electromagnets. Periodic reversal of the magnetic field can also be used to manipulate separation, and to enable the recovery of collected magnetic particles, by temporarily interrupting the magnetic field used to collect them.

The powder lots that that are larger in size than 53 microns are crystalline, with both $Cr_2B$ and ferrite present. In the case of the powder spray magnetic separation is used to remove undesirable crystalline phases from the powder. The magnet produces the magnetic field. The magnetic field removes undesirable crystalline phases from the powder.

The present invention provides a system for coating a surface. The system comprises providing a source of iron-based amorphous metal, the iron-based amorphous metal including devitrified ferrite; directing the iron-based amorphous metal toward the surface by a spray for coating the surface; and separating at least a portion of the devitrified ferrite from the spray before the spray reaches the surface. In one embodiment the separating at least a portion of the devitrified ferrite from the spray before the spray reaches the surface comprises magnetically separating at least a portion of the devitrified ferrite from the spray before the spray reaches the surface. In another embodiment the separating at least a portion of the devitrified ferrite from the spray before the spray reaches the surface comprises magnetically separating at least a portion of the devitrified ferrite from the spray before the spray reaches the surface using a natural magnet. In yet another embodiment the separating at least a portion of the devitrified ferrite from the spray before the spray reaches the surface comprises magnetically separating at least a portion of the devitrified ferrite from the spray before the spray reaches the surface using an electromagnet.

The present invention provides various methods of coating a surface. In one embodiment the method of coating a surface of the present invention wherein the step of separating at least a portion of the devitrified ferrite from the spray before the spray reaches the surface comprises magnetically separating at least a portion of the devitrified ferrite from the spray before the spray reaches the surface using a bar magnet. In one embodiment the method of coating a surface of the present invention wherein the step of separating at least a portion of the devitrified ferrite from the spray before the spray reaches the surface comprises magnetically separating at least a portion of the devitrified ferrite from the spray before the spray reaches the surface using at least one bar magnet in a rotating drum. In one embodiment the method of coating a surface of the present invention wherein the step of separating at least a portion of the devitrified ferrite from the spray before the spray reaches the surface comprises magnetically separating at least a portion of the devitrified ferrite from the spray before the spray reaches the surface using parallel troughs with a strong magnetic field. In one embodiment the method of coating a surface of the present invention wherein the step of separating at least a portion of the devitrified ferrite from the spray before the spray reaches the surface comprises magnetically separating at least a portion of the devitrified ferrite from the spray before the spray reaches the surface using magnetic-field assisted centrifugation. In one embodiment the method of coating a surface of the present invention wherein the step of separating at least a portion of the devitrified ferrite from the spray before the spray reaches the surface comprises magnetically separating at least a portion of the devitrified ferrite from the spray before the spray reaches the surface using magnetic-field assisted sieving and filtration. In one embodiment the method of coating a surface of the present invention wherein the step of separating at least a portion of the devitrified ferrite from the spray before the spray reaches the surface comprises magnetically separating at least a portion of the devitrified ferrite from the spray before the spray reaches the surface using magnetic-field assisted settling.

In one embodiment the method of coating a surface of the present invention wherein the step of providing a-source of iron-based amorphous metal comprises providing a source of iron-based amorphous metal powder. In one embodiment the method of coating a surface of the present invention wherein the step of providing a source of iron-based amorphous metal comprises providing a source of gas-atomized powders. In one embodiment the method of coating a surface of the present invention wherein the iron-based amorphous metal includes devitrified ferrite particles above 53 microns and the step of separating at least a portion of the devitrified ferrite from the spray before the spray reaches the surface comprises separating at least a portion of the devitrified ferrite particles above 53 microns from the spray before the spray reaches the surface.

In one embodiment the method of coating a surface of the present invention wherein the step of directing the iron-based amorphous metal toward the surface by a spray comprises using a high-velocity oxy-fuel spray process. In one embodiment the method of coating a surface of the present invention wherein the step of directing the iron-based amorphous metal toward the surface by a spray comprises using a plasma spray process. In one embodiment the method of coating a surface of the present invention wherein the step of directing the iron-based amorphous metal toward the surface by a spray comprises using a high-velocity air-spray process. In one embodiment the method of coating a surface of the present invention wherein the step of directing the iron-based amorphous metal toward the surface by a spray comprises using a detonation gun process. In one embodiment the method of coating a surface of the present invention wherein the step of directing the iron-based amorphous metal toward the surface by a spray comprises using a thermal spray process. In one embodiment the method of coating a surface of the present invention wherein the step of directing the iron-based amorphous metal toward the surface by a spray comprises using a flame spray process. In one embodiment the method of coating a surface of the present invention wherein the step of directing the iron-based amorphous metal toward the surface by a spray comprises using a cold spray process.

The present invention also provides an apparatus for coating a surface comprising a source of iron-based amorphous metal, the iron-based amorphous metal including devitrified ferrite; an application system for directing the iron-based amorphous metal toward the surface by a spray for coating the surface, and a system for separating at least a portion of the devitrified ferrite from the spray before the spray reaches the surface. In one embodiment the system for separating at least a portion of the devitrified ferrite from the spray before the spray reaches the surface comprises a magnet system for separating at least a portion of the devitrified ferrite from the spray before the spray reaches the surface. In another embodiment the system for separating at least a portion of the devitrified ferrite from the spray before the spray reaches the surface comprises at least one bar magnet in a rotating drum for magnetically separating at least a portion of the devitrified ferrite from the spray before the spray reaches the surface.

Applicants have conducted studies and analysis of systems of the present invention. The studies and analysis included the method comprising the steps of providing a source of iron-based amorphous metal, the iron-based amorphous metal including devitrified ferrite; directing the iron-based amorphous metal toward the surface by a spray for coating the surface, and separating at least a portion of the devitrified ferrite from the spray before the spray reaches the surface. Some of the results of the studies and analysis are provided below.

Figure 3:
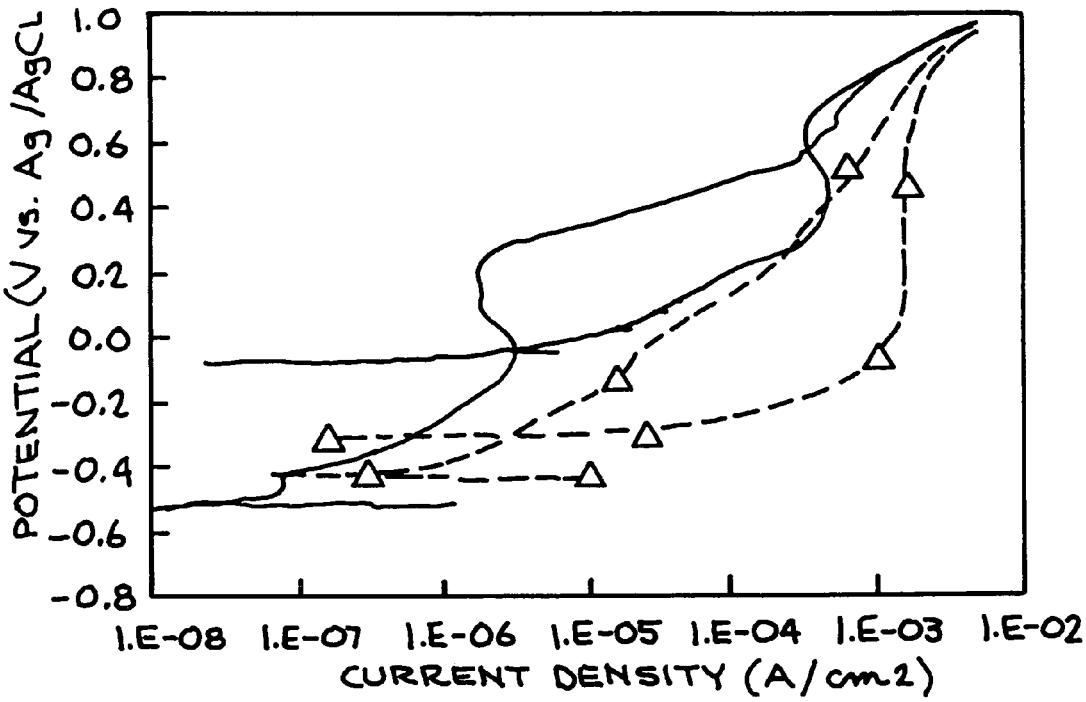
FIG. 3 is a graph shows cyclic polarization of crevice samples of wrought Ni-based Alloy C-22 and thermally sprayed Fe-based SAM2X5 coating performed with seawater at 90° C.

Referring now to FIG. 3, a graph shows cyclic polarization of crevice samples of wrought Ni-based Alloy C-22 and thermally sprayed Fe-based SAM2X5 coating performed with seawater at 90° C. In this case, the thermally sprayed coating was not optimized, and was formed from a relatively poor quality powder with substantial levels of residual crystalline phases present. Crystalline phases in such cases typically include bcc ferrite and $Cr_2B$. The crevice attack of Alloy C-22 initiated at approximately 200 mV vs. Ag/AgCl (~700 mV$\geqq E_{corr}$). The attack of the HVOF coating of SAM2X5 was due to general corrosion which occurred outside the crevice. Such general corrosion occurred at bcc ferrite particles that were introduced into the coating from poor quality atomized powder, thus showing the importance of quality control with such materials.

Figure 4A:
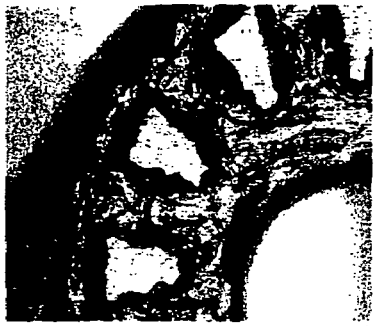
FIGS. 4A, 4B, 4C, and 4D show test samples.
Figure 4B:
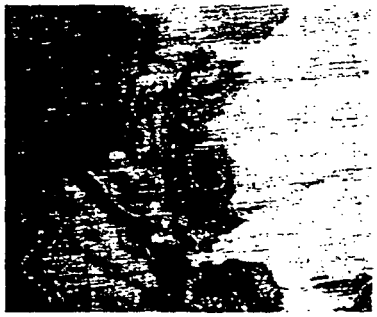
Figure 4C:
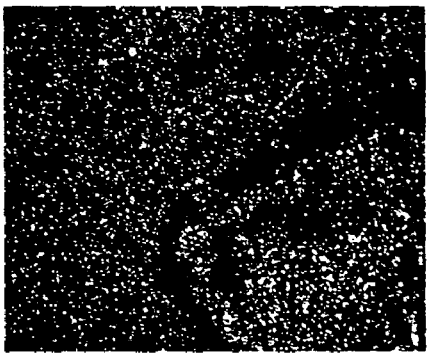
Figure 4D:
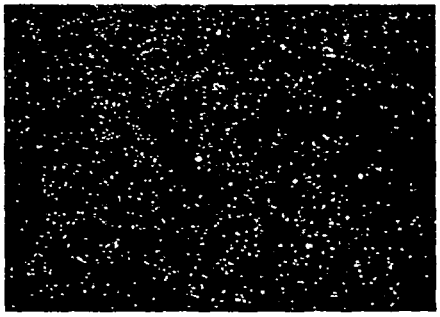

Referring now to FIGS. 4A, 4B, 4C, and 4D, different test samples are shown. FIG. 4A shows severe crevice attack on a standard Ni-based alloy C-22 'lollipop' sample in seawater at 90° C., which was initiated at approximately 200 mV vs. Ag/AgCl. FIG. 4B shows the crevice attack of the exposed Alloy C-22 on the back of the thermally sprayed lollipop sample. The attack of the SAM2X5 coating, which appears as brown spots, is shown in FIGS. 4C and 4D, and was due to corrosion of bcc ferrite particles embedded in the coating.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus for applying a coating to a surface of a structure, comprising:

an iron-based amorphous metal material that will be applied as the coating to the surface, devitrified ferrite with said iron-based amorphous metal material which is considered an undesirable devitrified ferrite, a source unit of said iron-based amorphous metal material including said undesirable devitrified ferrite;

an application system for directing said iron-based amorphous metal material including said undesirable devitrified ferrite located between said source unit and the surface of the structure, a spray stream of said iron-based amorphous metal material including said undesirable devitrified ferrite located between said application system and the structure, wherein said spray stream is used for coating the surface of the structure with said iron-based amorphous metal material; and a devitrified ferrite removal system operatively connected to said spray stream and located between said application system and the structure, said devitrified ferrite removal system including a magnetic field system for producing a magnetic field on said iron-based amorphous metal material in said spray stream between said application system and the structure, a diverted portion of said undesirable devitrified ferrite separated from said iron-based amorphous metal material in said spray stream, a collector positioned to receive said diverted portion of said undesirable devitrified ferrite that is separated from said iron-based amorphous metal material in said spray stream removing said diverted portion of said undesirable devitrified ferrite from said iron-based amorphous metal material in said spray stream, and a remaining portion of said spray stream with said diverted portion of said undesirable devitrified ferrite removed, wherein said remaining portion of said spray stream with said diverted portion of said undesirable devitrified ferrite removed is directed to the surface of the structure thereby providing the coating of said iron-based amorphous metal material on the surface of the structure wherein the coating is made of said iron-based amorphous metal with said diverted portion of said undesirable devitrified ferrite removed.

2. The apparatus for applying coating to a surface of claim 1 wherein said devitrified ferrite removal system comprises a magnet system for creating said magnetic field for magnetically separating said diverted portion of said undesirable devitrified ferrite from said iron-based amorphous metal material.

3. The apparatus for coating a surface of claim 1 wherein said system for separating at least a portion of said devitrified ferrite from said spray before said spray reaches the surface comprises a natural magnet for magnetically separating at least a portion of said devitrified ferrite from said spray before said spray reaches the surface.

4. The apparatus for applying coating to a surface of claim 1 wherein said devitrified ferrite removal system includes an electro-magnet for creating said magnetic field for magnetically separating said diverted portion of said undesirable devitrified ferrite from said iron-based amorphous metal material in said spray stream before said spray stream reaches the surface.

5. The apparatus for coating a surface of claim 1 wherein said system for separating at least a portion of said devitrified ferrite from said spray before said spray reaches the surface comprises a bar magnet for magnetically separating at least a portion of said devitrified ferrite from said spray before said spray reaches the surface.

6. The apparatus for coating a surface of claim 1 wherein said system for separating at least a portion of said devitrified ferrite from said spray before said spray reaches the surface comprises at least one bar magnet in a rotating drum for magnetically separating at least a portion of said devitrified ferrite from said spray before said spray reaches the surface.

7. The apparatus for coating a surface of claim 1 wherein said system for separating at least a portion of said devitrified ferrite from said spray before said spray reaches the surface comprises parallel troughs with a strong magnetic field for magnetically separating at least a portion of said devitrified ferrite from said spray before said spray reaches the surface.

8. The apparatus for coating a surface of claim 1 wherein said system for separating at least a portion of said devitrified ferrite from said spray before said spray reaches the surface comprises magnetic-field assisted centrifuge for magnetically separating at least a portion of said devitrified ferrite from said spray before said spray reaches the surface.

9. The apparatus for coating a surface of claim 1 wherein said system for separating at least a portion of said devitrified ferrite from said spray before said spray reaches the surface comprises a magnetic-field assisted sieving and filtration system for magnetically separating at least a portion of said devitrified ferrite from said spray before said spray reaches the surface.

10. The apparatus for coating a surface of claim 1 wherein said system for separating at least a portion of said devitrified ferrite from said spray before said spray reaches the surface comprises a magnetic-field assisted settling system for magnetically separating at least a portion of said devitrified ferrite from said spray before said spray reaches the surface.

11. The apparatus for applying coating to a surface of claim 1 wherein said iron-based amorphous metal material comprises iron-based amorphous metal powder.

12. The apparatus for applying coating to a surface of claim 1 wherein said iron-based amorphous metal material comprises gas-atomized iron-based amorphous metal powders.

13. The apparatus for applying coating to a surface of claim 1 wherein said devitrified ferrite removal system includes a rotating drum with a multiplicity of magnetic bars.

14. The apparatus for coating a surface of claim 1 wherein said system for directing said iron-based amorphous metal toward the surface by a spray comprises a high-velocity oxy-fuel sprayer.

15. The apparatus for coating a surface of claim 1 wherein said system for directing said iron-based amorphous metal toward the surface by a spray comprises a plasma sprayer.

16. The apparatus for coating a surface of claim 1 wherein said system for directing said iron-based amorphous metal toward the surface by a spray comprises a high-velocity air-sprayer.

17. The apparatus for coating a surface of claim 1 wherein said system for directing said iron-based amorphous metal toward the surface by a spray comprises a detonation gun.

18. The apparatus for coating a surface of claim 1 wherein said system for directing said iron-based amorphous metal toward the surface by a spray comprises a thermal sprayer.

19. The apparatus for coating a surface of claim 1 wherein said system for directing said iron-based amorphous metal toward the surface by a spray comprises a flame sprayer.

20. The apparatus for applying coating to a surface of claim 1 wherein said application system for directing said iron-based amorphous metal material including said undesirable devitrified ferrite comprises a cold sprayer.

* * * * *